US007789034B1

(12) United States Patent
Simpson, Sr.

(10) Patent No.: US 7,789,034 B1
(45) Date of Patent: Sep. 7, 2010

(54) AIRBOAT SUSPENSION SYSTEM

(76) Inventor: David W. Simpson, Sr., 21900 State Rd. 60, Vero Beach, FL (US) 32966

( * ) Notice: Subject to any disclaimer, the term of this patent is extended or adjusted under 35 U.S.C. 154(b) by 89 days.

(21) Appl. No.: 12/201,512

(22) Filed: Aug. 29, 2008

Related U.S. Application Data

(60) Provisional application No. 60/969,363, filed on Aug. 31, 2007.

(51) Int. Cl.
*B63B 17/00* (2006.01)

(52) U.S. Cl. ..... 114/363; 440/37

(58) Field of Classification Search ..... 114/363; 297/334.16, 325, 326, 344.11, 452.54; 440/37
See application file for complete search history.

(56) References Cited

U.S. PATENT DOCUMENTS

| | | | | |
|---|---|---|---|---|
| 3,841,649 | A | 10/1974 | McMullen | |
| 3,917,301 | A | 11/1975 | Fabris | |
| 4,165,087 | A | 8/1979 | Kagawa | |
| 4,193,609 | A | 3/1980 | Bissett | |
| 4,260,036 | A | 4/1981 | Bissett | |
| 4,632,408 | A | 12/1986 | Olpp et al. | |
| 4,662,597 | A | 5/1987 | Uecker et al. | |
| 5,309,861 | A | 5/1994 | Markikian | |
| 5,367,978 | A | 11/1994 | Mardikian | |
| 5,603,281 | A | 2/1997 | Harvey et al. | |
| 5,970,898 | A | 10/1999 | Pereira | |
| 6,019,380 | A | 2/2000 | Goodman et al. | |
| 6,036,202 | A | 3/2000 | LaCome | |
| 6,176,190 | B1 | 1/2001 | Ozga | |
| 6,179,305 | B1 | 1/2001 | Capozzi et al. | |
| 6,179,676 | B1 | 1/2001 | Wilborn et al. | |
| 6,371,456 | B1 * | 4/2002 | Ritchie et al. | 267/64.12 |
| 6,431,562 | B1 | 8/2002 | Vontobel | |
| 6,540,570 | B1 * | 4/2003 | Eakin | 440/37 |
| 6,783,134 | B2 | 8/2004 | Geary | |
| 6,880,483 | B2 * | 4/2005 | Fedders | 114/363 |
| 6,889,625 | B1 | 5/2005 | Loffler | |
| 6,905,128 | B1 | 6/2005 | Lear et al. | |

FOREIGN PATENT DOCUMENTS

| | | |
|---|---|---|
| CH | 686240 | 2/1996 |
| JP | 2006056345 | 3/2006 |

* cited by examiner

*Primary Examiner*—Stephen Avila
(74) *Attorney, Agent, or Firm*—Michael K. Dixon; Akerman Senterfitt

(57) ABSTRACT

A suspension system for an airboat is disclosed. The suspension system may support a seating system on an airboat and may be configured to absorb forces from waves, running over dry ground, et cetera. The suspension system may include one or more dampers configured to absorb forces to smooth out the ride on the airboat. In at least one embodiment, the suspension system may include adjustable dampers that enable the amount of dampening to be adjusted to accommodate different loads, such as more or less people seated on the airboat.

18 Claims, 6 Drawing Sheets

AIRBOAT SUSPENSION SYSTEM

CROSS-REFERENCE TO RELATED APPLICATION

This patent application claims the benefit of U.S. Provisional Patent Application No. 60/969,363, filed Aug. 31, 2007, which is incorporated by reference in its entirety.

FIELD OF THE INVENTION

The invention is directed generally to airboats, and more particularly, to airboat suspension systems.

BACKGROUND

Airboats typically include a seat structure that supports a couple of seats, for the driver and passenger, in front of the motor and above the deck of the airboat. The seat structure is raised above the deck of the vessel to increase the visibility of the driver so that the driver may see over wetland vegetation and to limit that mount of vegetation blown onto the driver while running. The seat structures are typically rigidly attached directly to support structures in the airboats. Airboats are typically operated in marshes, but also can be operated over dry ground. Such operation on dry ground creates jarring forces when bumps are hit. The jarring forces are transferred directly from the airboat to the driver and others on the airboat. Prolonged exposure to such jarring forces can injure the driver and others.

SUMMARY OF THE INVENTION

This invention is directed to a suspension system for an airboat. The suspension system may support a seating system on an airboat and may be configured to absorb forces from waves, running over dry ground, et cetera. The suspension system may include one or more dampers configured to absorb forces to smooth out the ride on the airboat. In at least one embodiment, the suspension system may include adjustable dampers that enable the amount of dampening to be adjusted to accommodate different loads, such as more or less people seated on the airboat.

The suspension system may be adaptable to retrofit currently existing airboats such that seat support structures are supported partially by a damper, and the seat support structure is pivotably attached to the airboat or other support member. In one embodiment, the damper may extend from a generally horizontal seat support structure to a generally vertical support bracket. The seat support structure may be pivotably attached to the vertical support bracket and may be cantilevered out past the damper toward the bow of the boat. In other embodiments, the damper may extend from a seat support structure downwardly and be attached to the floor of the boat or other support structure on the floor of the boat.

An advantage of this invention is that the damper absorbs shocks imparted on the airboat while the airboat is running, thereby preventing the forces from being transmitted to the passengers seated in seats on the seat support structure.

Another advantage of this invention is that the airboat suspension system eliminates supports from beneath the seat support structure, thereby providing increased, unobstructed storage areas in the boat.

Yet another advantage of this invention is that delicate materials, such as optics, may be stored on the seat support structure with reduced risk of damage from shock and vibration.

Another advantage of this invention is that the suspension system reduces damage to the boat hull caused in conventional airboats by forces generated by the seat and passengers on the seats when the boat is run over dry ground.

These and other features and advantages of the present invention will become apparent after review of the following drawings and detailed description of the disclosed embodiments.

BRIEF DESCRIPTION OF THE DRAWINGS

The accompanying drawings, which are incorporated in and form a part of the specification, illustrate preferred embodiments of the presently disclosed invention(s) and, together with the description, disclose the principles of the invention(s). These several illustrative figures include the following.

DETAILED DESCRIPTION OF THE INVENTION

Figure 1:
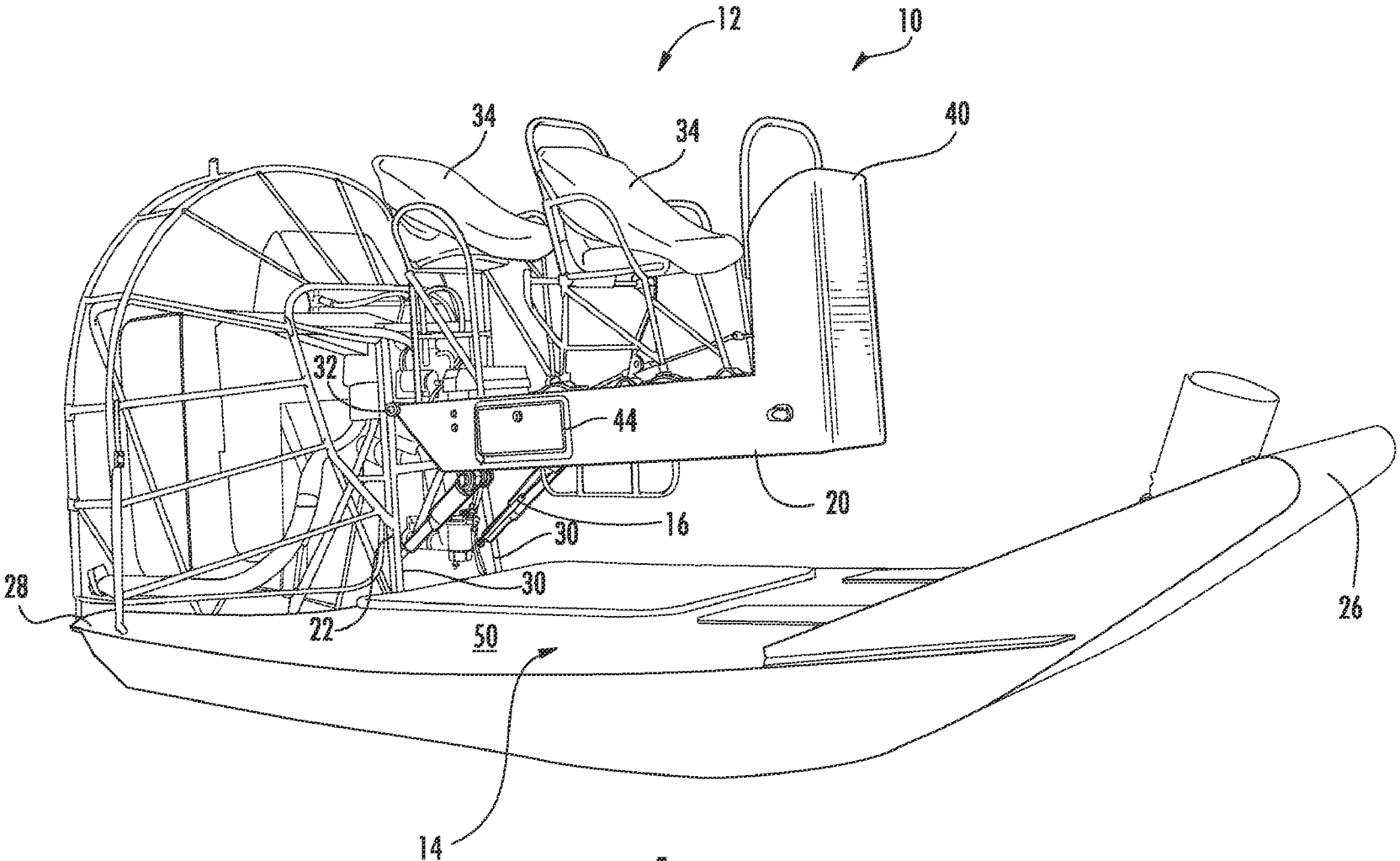
FIG. 1 is a perspective view of the suspension system of the invention installed on an airboat.
Figure 2:
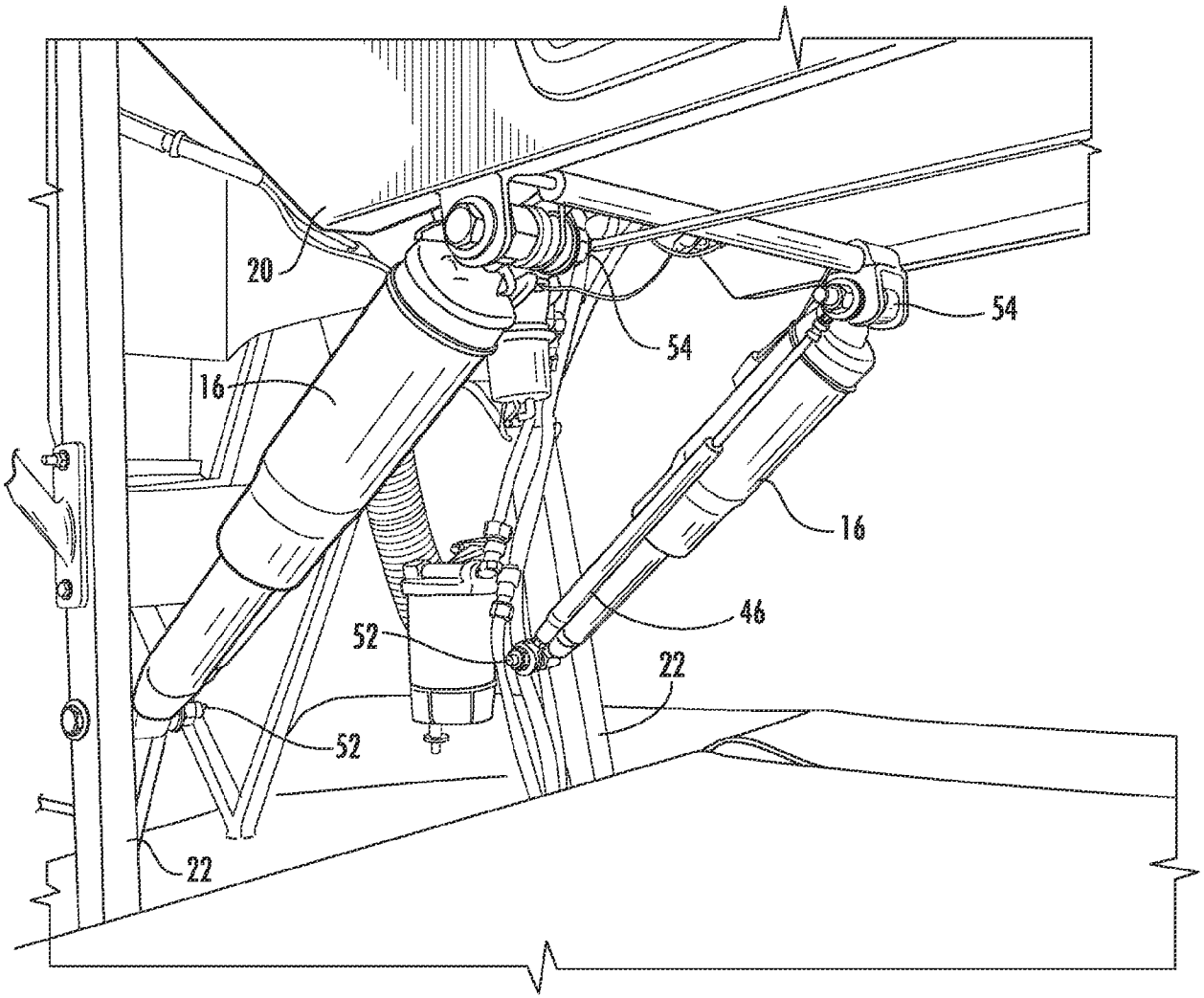
FIG. 2 is a detailed perspective view of the suspension system of FIG. 1.
Figure 3:
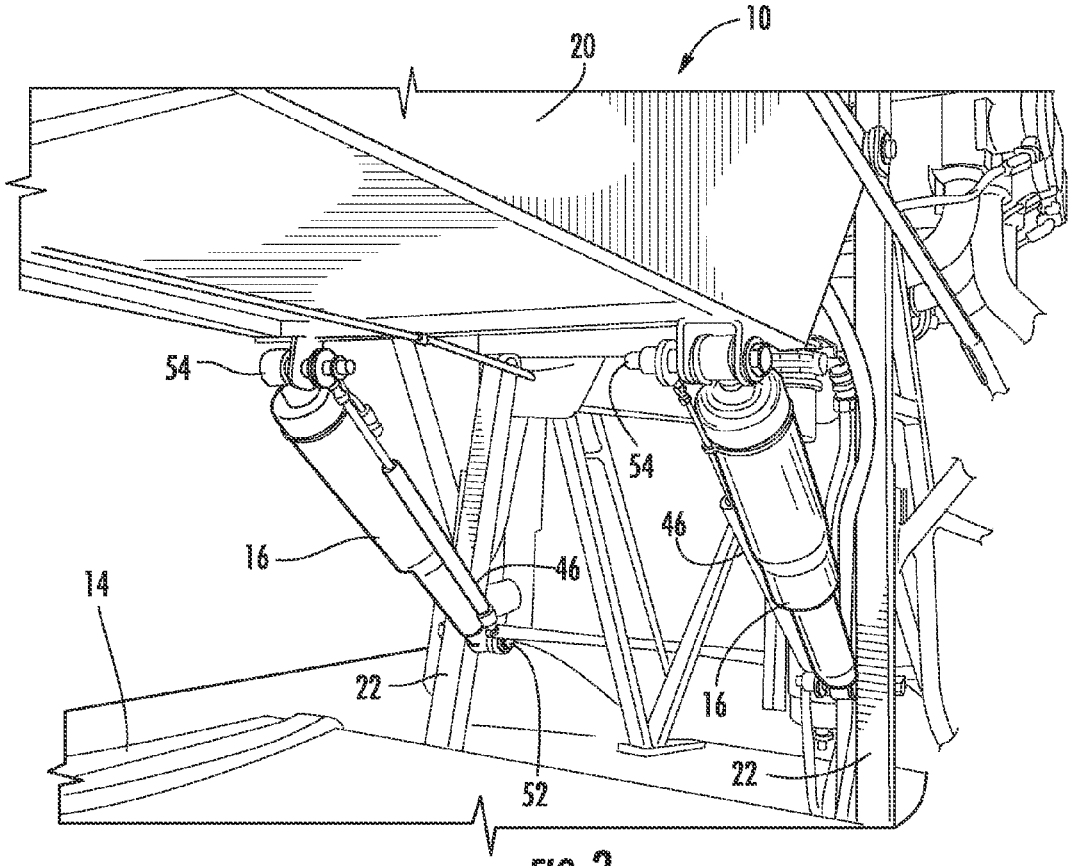
FIG. 3 is a detailed perspective view of the suspension system of FIG. 1 taken at a different angle.
Figure 4:
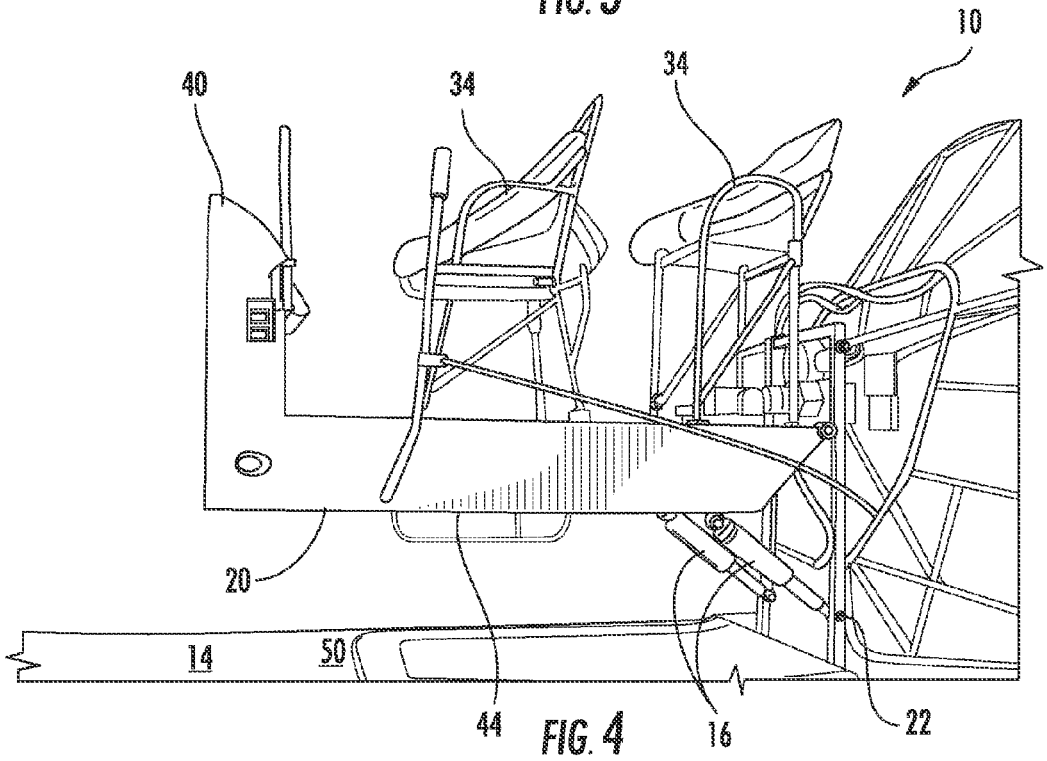
FIG. 4 is a side view of the suspension system of FIG. 1.

As shown in FIGS. 1-9, this invention is directed to a suspension system 10 for an airboat 14. The airboat 14 includes a propeller driven propulsion system for pushing air that propels the airboat 14. The suspension system 10 may support a seating system 12 on an airboat 14 and may be configured to absorb forces from waves, running over dry ground, et cetera. The suspension system 10 may include one or more dampers 16 configured to absorb forces to smooth out the ride on the airboat 14. In at least one embodiment, the suspension system 10 may include adjustable dampers 16 that enable the amount of dampening to be adjusted to accommodate different loads, such as more or less people seated on the airboat 14.

As shown in the FIGS. 1-9, the suspension system 10 may be formed from a seat support structure 20 suspended above a deck 50 of a vessel, such as an airboat 14. The airboat 14 may be any appropriately sized boat, such as, but not limited to, between about 10 feet and about 18 feet in length and about five feet and about ten feet in width. The airboat 14 may be formed from, but is not limited to, aluminum, fiberglass, epoxy, carbon kevlar, or other appropriate materials. The seat support frame 20 may be suspended above the airboat 14 with a support bracket 22. The support bracket 22 may be attached to the airboat 14 and may extend upwardly from the airboat 14, such as in a generally vertical direction above the deck 50 of the airboat 14. In at least one embodiment, the support bracket 22 may extend generally vertically from the boat 14. The support bracket 22 may also be positioned in the all region of the boat 14 and may support a portion of the engine.

The support bracket 22 may be supported to prevent the support bracket 22 from flexing forward under the load of the seat support structure 20.

The seat support structure 20 may extend outwardly from the support bracket 22 towards the bow of the boat 14. In at least one embodiment, the seat support structure 20 may extend generally horizontally from the support bracket 22. The seat support structure 20 may be pivotably attached to the support bracket 22 such that the seat support structure 20 may pivot about an axis 24 generally orthogonal to an axis 24 extending from the bow 26 to the stern 28 of the boat 14. The seat support structure 20 may be pivotably attached to the support bracket 22 at two locations that are generally adjacent to each other on two adjacent legs 30 of the support bracket 22. The legs 30 of the support bracket 22 may be positioned a sufficient distance from each other to support the seat support structure 20, which may be, but is not limited to, between about 12 and about 30 inches in one embodiment.

As shown in the attached figures, the seat support structure 20 may be supported in position relative to the support bracket 22 with a damper 16. The damper 16 may be, but is not limited to being, a hydraulic shock, an air shock, an adjustable pressure air shock, an adjustable coil over shock and other appropriate devices. The damper 16 may be pivotably attached at a pivot point 52 to the support bracket 22 at a first end below the point at which the seat support structure 20 is attached to the support bracket 22. The damper 16 may also be pivotably attached to the seat support structure 20 at a pivot point 54 a second end. In one embodiment, the damper 16 may be attached to the seat support structure 20 on the rearmost quarter of the seat support structure 20. In some embodiments in which heavier loads are anticipated, the damper 16 may be attached to the seat support structure 20 closer to the front of the seat support structure 20. In such a configuration, a substantial portion of the seat support structure 20 is cantilevered out from the support structure, thereby creating additional moment forces about the pivot point 32 on the support bracket 22. These additional moment threes cause the damper 16 to absorb more forces and create a smooth ride on the seat support structure 20.

Figure 5:
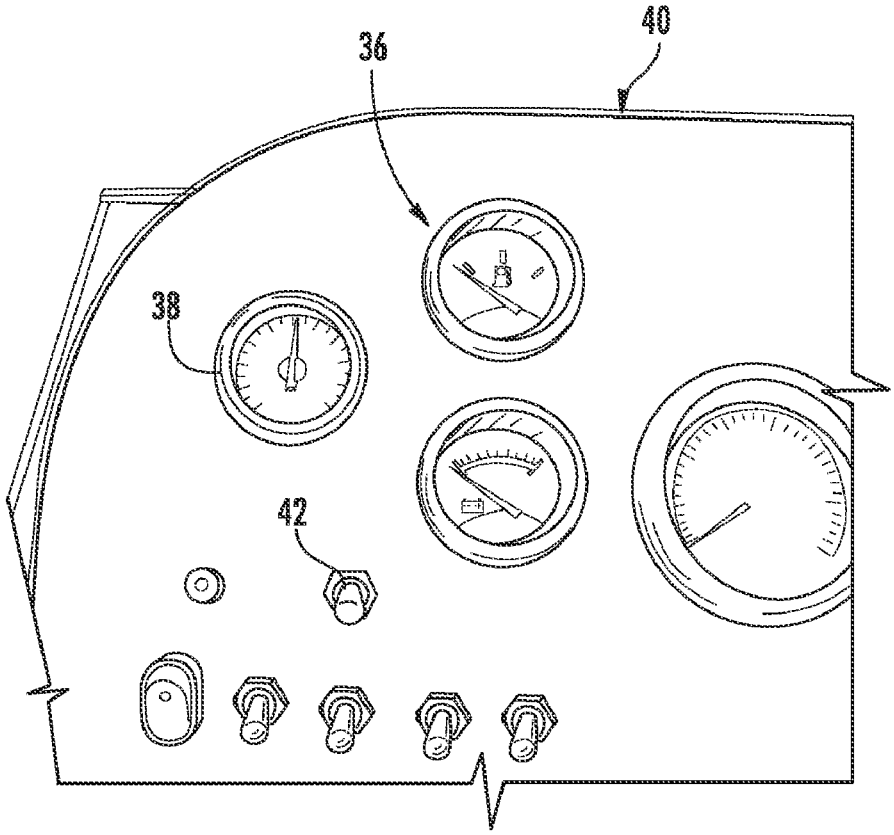
FIG. 5 is top view of a control panel including controls for the suspension system of FIG. 1.
Figure 6:
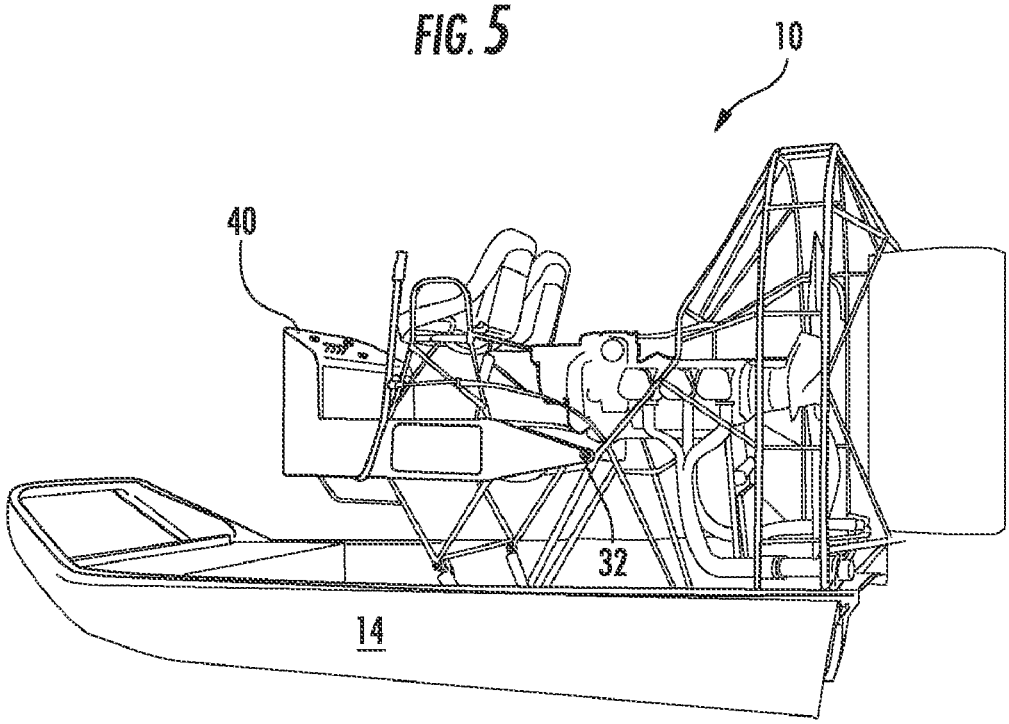
FIG. 6 is a side view of an alternative embodiment of the suspension system.
Figure 7:
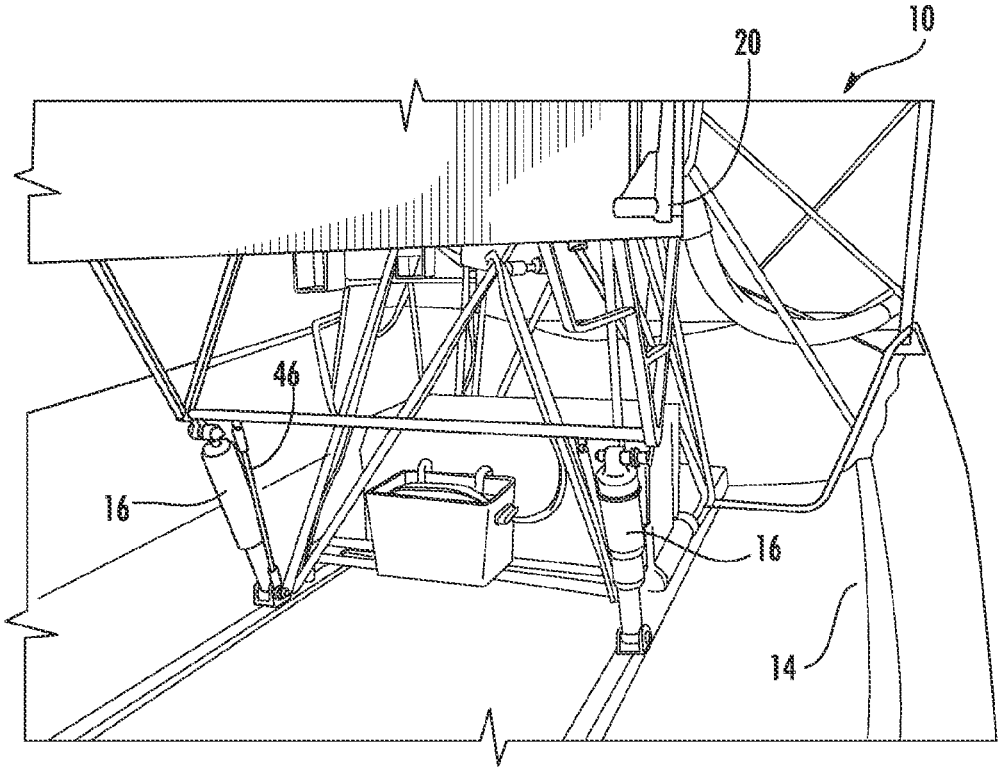
FIG. 7 is a perspective view of the suspension system or FIG. 6.
Figure 8:
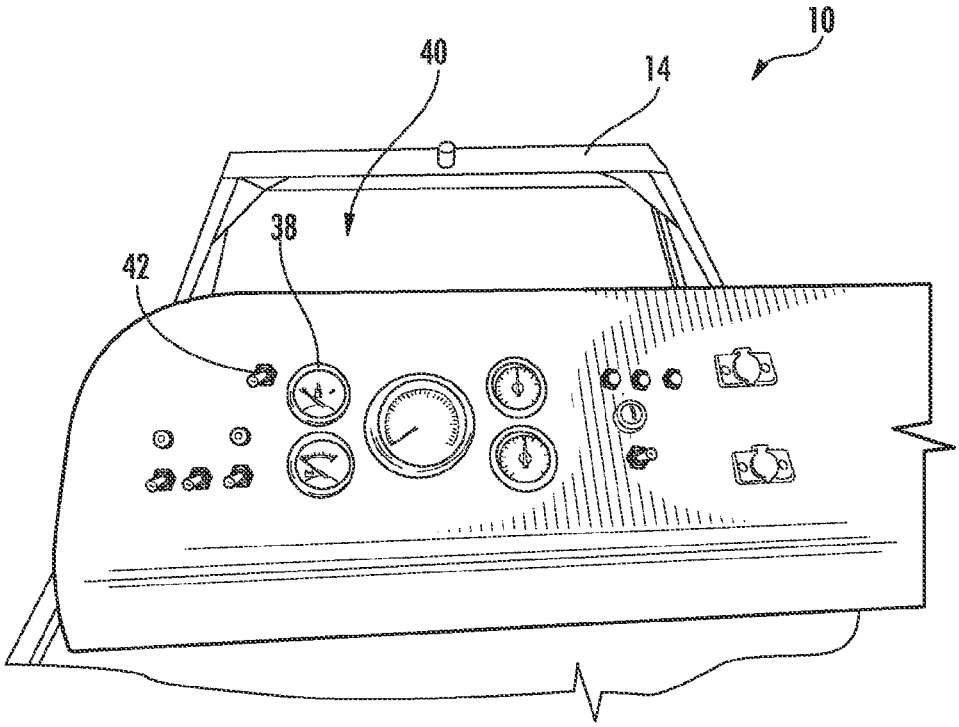
FIG. 8 is a top view of a control panel including controls for the suspension system of FIG. 6.

The seat support structure 20 may support a plurality of different components. For instance and not by way of limitation, the seat support structure 20 may support one or more seats 34, such as two seats 34 shown in FIG. 1, airboat operating controls, including a pivotably rudder control arm, a foot actuated accelerator pedal, gauges, such as but not limited to, oil pressure gauge, engine coolant temperature, engine rpm gauge, and other appropriate devices. The control panel 40, as shown in FIG. 5, may also include a switch 42 for controlling the air pressure in the damper 16. The control panel 40 may also include a gauge 38 displaying the amount of air pressure in the damper 16. The seat support structure 20 may also include enclosed storage 44 beneath the seats 34 and accessible through hatches on the top or side surfaces of the seat support structure 20.

The damper 16 may include a guard 46, such as a cable guard 46, to prevent the damper 16 from overextending. For instance, the cable guard 46 may extend from each end of the damper 16 to prevent the damper 16 from overextending and damaging itself. The cable guard 46 may be formed from cable or another appropriate material.

Figure 9:
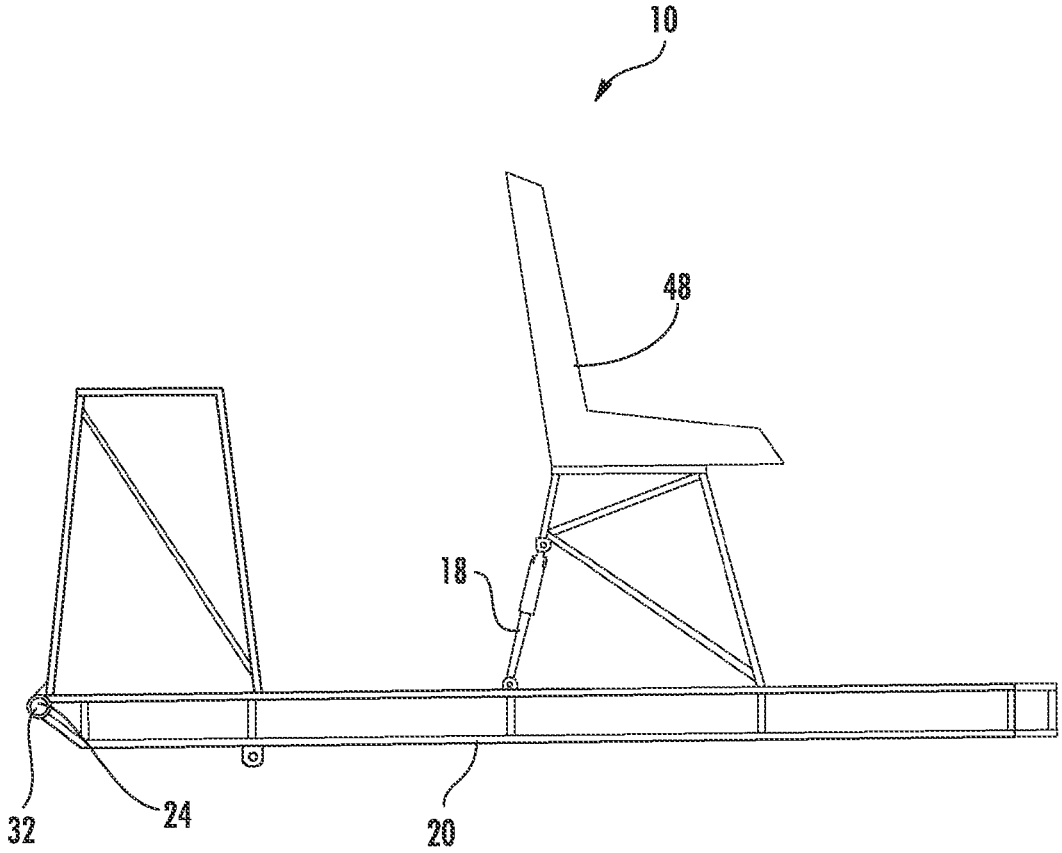
FIG. 9 is a side view of a seat of the suspension system that is supported by a damper.

The suspension system 10 may also include a dampened seat 48, as shown in FIG. 9. The seat 48 may be at least partially support by one or more dampers 18 extending between the seat 48 and the seat support structure 20. The seat 48 may also be attached to the seat support structure 20 at a pivot point. The damper 18 on the seat 48 may be used in addition to the damper 16 supporting the seat support structure 20, thereby increasing the dampening effect realized by a passenger riding in the seat 48.

During use, after the seat support structure 20 has been loaded with the driver and possibly one or more passengers, the switch 42 may be used to add or release air from the damper 16 to adjust the amount of dampening found in the suspension system 10. The suspension system 10 may be adjusted while the airboat is moving or while stationary. An air pump (not shown) may be used to inflate the damper 16.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. An airboat suspension system, comprising:

a seat support structure having at least one seat and pivotably coupled to an airboat vessel at a pivot point; and at least one damper attached to the seat support structure at a first end and supported by the airboat at a second end such that the seat support structure may pivot about the pivot point to cushion shock created by the airboat while the airboat is underway;

wherein the seat support structure is supported in a generally horizontal position, cantilevered from a motor support bracket such that the seat support structure pivots about an axis generally orthogonal to an axis extending from a bow to a stern of the boat and creates an unobstructed opening below the seat support structure.

2. The airboat suspension system of claim 1, wherein the at least one damper is comprised of an adjustable damper.

3. The airboat suspension system of claim 2, wherein the at least one damper is comprised of an adjustable pressure air shock.

4. The airboat suspension system of claim 2, wherein the at least one damper comprises two dampers.

5. The airboat suspension system of claim 1, wherein seat support structure is pivotably attached to a support bracket above a floor of the airboat.

6. The airboat suspension system of claim 1, wherein the seat support structure is pivotably attached to the support bracket at two locations that are generally adjacent to each other on two adjacent legs of the support bracket.

7. The airboat suspension system of claim 1, wherein the at least one damper is attached to the seat support structure on the rearmost quarter of the seat support structure.

8. The airboat suspension system of claim 1, further comprising a switch for controlling the air pressure in the at least one damper.

9. The airboat suspension system of claim 1, further comprising a guard to prevent the damper from overextending.

10. The airboat suspension system of claim 9, wherein the guard may extend from each end of the at least one damper to prevent the damper from being overextended and getting damaged.

11. The airboat suspension system of claim 1, further comprising a seat attached to the seat support structure that is dampened to absorb shock.

12. An airboat suspension system, comprising:

a seat support structure having at least one seat and pivotably coupled to an airboat at a pivot point;

a seat attached to the seat support structure that is dampened to absorb shock;

at least one damper attached to the seat support structure at a first end and supported by the airboat at a second end such that the seat support structure may pivot about the pivot point to cushion shock created by the airboat while the airboat is underway and such that the seat support structure is cantilevered; and wherein seat support structure is supported in a generally horizontal position, cantilevered from a motor support bracket such that the seat support structure pivots about an axis generally orthogonal to an axis extending from a bow to a stern of the boat and creates an unobstructed opening below the seat support structure.

13. The airboat suspension system of claim 1, wherein the at least one damper is comprised of an adjustable damper.

14. The airboat suspension system of claim 13, wherein the at least one damper is comprised of an adjustable pressure air shock.

15. The airboat suspension system of claim 12, wherein the seat support structure is pivotably attached to the support bracket at two locations that are generally adjacent to each other on two adjacent legs of a support bracket that support the seat support structure and to which the seat support structure is attached.

16. The airboat suspension system of claim 1, further comprising a switch for controlling the air pressure in the at least one damper.

17. The airboat suspension system of claim 1, further comprising a guard to prevent the damper from overextending.

18. An airboat suspension system, comprising:

a seat support structure having at least one seat and pivotably coupled to an airboat at a pivot point;

at least one adjustable damper attached to the seat support structure at a first end and supported by the airboat at a second end such that the seat support structure may pivot about the pivot point to cushion shock created by the airboat while the airboat is underway and such that the seat support structure is cantilevered; and wherein seat support structure is supported in a generally horizontal position, cantilevered from a motor support bracket such that the seat support structure pivots about an axis generally orthogonal to an axis extending from a bow to a stern of the boat and creates an unobstructed opening below the seat support structure.

* * * * *